United States Patent [19]

Henricks

[11] 4,418,125

[45] Nov. 29, 1983

[54] MULTI-LAYER MULTI-METAL ELECTROPLATED PROTECTIVE COATING

[76] Inventor: John A. Henricks, 742 N. Oak Park Ave., Oak Park, Ill. 60302

[21] Appl. No.: 432,562

[22] Filed: Dec. 6, 1982

[51] Int. Cl.[3] ..... C25D 5/14; B32B 15/01; B32B 15/18

[52] U.S. Cl. ..... 428/639; 204/40; 204/41; 428/657; 428/667; 428/674; 428/675; 428/679

[58] Field of Search ..... 204/41, 40; 428/639, 428/657, 667, 674, 675, 679

[56] References Cited

U.S. PATENT DOCUMENTS

| | | | |
|---|---|---|---|
| 2,124,657 | 7/1938 | Ritzenthaler et al. | 204/41 X |
| 3,090,733 | 5/1963 | Brown | 204/40 |
| 4,154,139 | 5/1979 | Hage | 428/675 X |

*Primary Examiner*—G. L. Kaplan

[57] ABSTRACT

This invention is directed to the formation of highly protective electroplated multi-metal coatings over an iron basis metal. The high degree of protection is obtained by the deposition of three sucessive layers of two dissimilar metal layers that form a galvanic cell in which one of the two adjacent metals is anodic to the other so that the corroding anodic electroplate will spread the attack laterally and thus prevent the corrosive media from drilling through to the base metal.

2 Claims, No Drawings

MULTI-LAYER MULTI-METAL ELECTROPLATED PROTECTIVE COATING

This invention relates to the design of multi-metal electroplated protective coatings for steel. The protective value of nickel plate over steel is limited by the degree of porosity of the nickel plate since the steel is anodic to the nickel and will corrode rapidly through any pores in the nickel plate. Thus a highly protective nickel plate must be quite heavy to avoid this destructive porosity. The elimination of pores in a nickel deposit would require about two mils (0.002") to fully protect the active iron base metal. It is a primary object of this invention to provide a fully protective plated coating over steel with only about one mil (0.001") of a multi-metal, multi-layer coating.

Multi-layer, multi-metal nickel coatings are not new to the art. Dr. William Blum at the U.S. Bureau of Standards showed that a multi-layer of alternating copper and nickel was superior to the same thickness of either metal as a protective plate for steel printing plates. (Wm.Blum,Trans. Amer. Electrchem. Soc. vol. 40, page 137,1921) Back in 1930 the New Era Bumper Corp. In Jackson Mich. produced auto bumpers having a duplex coating of cadmium over the steel followed by nickel and chromium plate. However, this sytem was plagued with occasional loss of bond in the nickel, and a tendency for the duplex plate to blister under corrosive conditions. These problems lead to the substitution of copper plate for the cadmium plate.

The most valuable improvement in multi-layer protective coatings came with duplex nickel with the combination of a layer of sulfur free leveling nickel with a layer of sulfur containing bright nickel. (Brit. Pat. No. 684,434 of 1952, and U.S. Pat. No. 2,635,075 of 1953 to J. F. Vogt et al) The high protective value of the duplex nickel plate lies in the fact that the sulfur containing nickel is anodic to the pure leveling nickel to that it spreads the corrosion laterally to avoid drilling down to the base metal. This invention utilizes two separate layers of duplex nickel to achieve its high degree of protective value. In the prior art, multi-layer coatings were suggested that began with an alloy nickel coating over the steel base. We have found superior protection if we use a duplex nickel instead of a nickel alloy at the steel interface.

We have also found that cadmium plate can be used in a multi-layer plate without the bond loss and blistering that marred the use of cadmium at the New Era Bumper plant. The trick is to coast the cadmium directly over the duplex nickel layer at the steel base and to protect the cadmium with sucessive layers of copper, duplex nickel, and microporous chromium. The protective value of my preferred combination of metal layers can best be understood by checking the relative reactivity of the metals that make up the multi-layer plate.

TABLE I

| Relative Rectivity of Metals used in Composite Coating |
|---|
| (1) Cadmium (most active) |
| (2) Iron base metal. |
| (3) Sulfur containing Bright Nickel |
| (4) Sulfur free Nickel |
| (5) Copper |
| (6) Microporous Chromium (most noble) |

TABLE II

| Preferred Multi-layer Protective Plate | |
|---|---|
| METAL | REACTIVITY |
| (1) Iron base | 2 |
| (2) Sulfur free Nickel | 4 |
| (3) Sulfur containing Bright Nickel | 3 |
| (4) Cadmium | 1 |
| (5) Copper | 5 |
| (6) Sulfur free Nickel | 4 |
| (7) Sulfur contained Bright Nickel | 3 |
| (8) Microporous Chromium | 6 |

TABLE III

| Local Cells in Composite Coating |
|---|
| (1) Iron base metal anodic to pure Level Nickel |
| (2) Pure Level Nickel (cathode) |
| (3) Sulfur containing Bright Nickel anodic to Pure Level Nickel |
| (4) Cadmium anodic to pure Level Nickel |
| (5) Cadmium anodic to Copper |
| (6) Copper (cathode) |
| (7) Pure Nickel anodic to Copper |
| (8) Sulfur containing Bright Nickel anodic to pure Nickel |
| (9) Sulfur containing Bright Nickel anodic to Chromium |
| (10) Microporous Chromium (cathode) |

It should be pointed out that Henry Brown of Udylite improved the duplex nickel by the addition of a third thin layer of nickel with a higher sulfur content than the sulfur containing Bright Nickel and anodic to both other nickel layers. (U.S. Pat. No. 3,090,733). This improvement could be utilized in either, or both, of the duplex nickel layers for very severe corrosive conditions if the added cost of these extra plating steps could be absorbed. However, we have found that the two duplex nickel layers offer excellent corrosion protection for the average corrosion demand.

It is the purpose of this invention to design a repeating series of local cells or batteries in which the sacrificial anodic metal will react with invading corrosive agents to halt the corrosion sacrificialy and spread the corrosion laterally and delay puncture through to the base metal. By the planned use of a balanced series of such cells containing a sacrificial metal to spread the corrosion laterally, we can greatly increase the protective value of the electroplate without greatly increasing the plating thickness. The design of these composite coatings made up of a series of sacrificial cells is illustrated in the following Example which has been designed to contain three separate sacrificial sandwiches in the multi-layer deposit to act as corrosion barriers. We first place a duplex nickel against the steel base with the sulfur Bright nickel anodic to the sulfur-free nickel and follow this cell with the copper-cadmium cell, and top the composite with a second duplex nickel with the sacrificial sulfur Bright nickel adjacent to the chromium. All of this plating baths used to plate the multi-layer composite of this inventionare the conventional time proven commercial electrolytes, such as the following, (1) NICKEL—All of the Nickel systems are based upon the regular Watts bath, the differences being in the selection of the special brighteners. The sulfur free leveling nickel baths obtain their leveling by the use of coumarin or acetylenic alcohols, sometimes augmented with aldehydes like chloral. The sulfur containing Bright nickel deposits obtain their sulfur content by the use of aromatic sulfonic acids, sulfonamides, or saccharin brightener systems. To enhance the nickel lustre, these bright nickel baths usually have an acetylenic brightener as well as the sulfon compound.

CADMIUM—A regular cadmium cyanide bath made from cadmium oxide dissolved with an excess of sodium cyanide is used for cadmium.

COPPER—The old copper cyanide using tartrates for anode efficiency is preferred.

CHROMIUM—Microporous chromium is obtained in the regular Fink chromic acid bath by a carefull balance of the sulfate ratio, bath temperature, and current density.

The highly protective composite coatings derive their value from the properties of the sacrificial galvanic cells, rather than the plating bath itself.

This invention can be illustrated by the following Example in which each separate metal layer was plated to the thickness shown in the Example using one of the previously described commercial plating baths after the work had been carefully cleaned. The plating time required for the specific plate thickness can be calculated from the following Table,

TABLE IV

| Minutes required to deposit Q.0001" of metal plate | |
|---|---|
| Cadmium | 2.0 minutes at 30 Amperes per sq. ft. |
| Nickel | 3.0 minutes at 40 Amperes per sq. ft. |
| Copper | 4.0 minutes at 20 Amperes per sq. ft. |
| Chromium | 24.0 minutes at 125 Amperes per sq. ft. |

TABLE IV-continued

| Example of Multi-layer multi-metal Composite Electroplated Finish | | |
|---|---|---|
| | METAL PLATE THICKNESS | |
| METAL PLATE (Steel Base Metal) | Preferred Plate | Thickness Range |
| (1) Sulfur free Nickel | 0.00015" | .0001"-.0002" |
| (2) Sulfur containing bright Nickel | 0.00015" | .0001"-.0002" |
| (3) Cyanide Cadmium | 0.00020" | .0002"-.0003" |
| (4) Tartrate cyanide Copper | 0.00020" | .0001"-.0003" |
| (5) Sulfur free Nickel | 0.00015" | .0001"-.0003" |
| (6) Sulfur containing bright Nickel | 0.00015" | .0001"-.0003" |
| (7) Microporous Chromium | 0.00001" | .00001"-.00003" |

It should be understood that this invention is not limited to the Example given above. It is to be understood that the thickness of the various metal layers can be varied, and that a third thin nickel plate high in sulfur can be inserted, if needed, as taught in U.S. Pat. No. 3,090,733 by Henry Brown.

What I claim is:

1. A method of electroplating a composite protective coating for steel which comprises electroplating on said steel an initial layer of about 0.00015" of sulfur free nickel, followed by about 0.00015" of sulfur containing bright nickel and followed in sucession by about 0.0002" of cadmium and by about 0.0002" of copper which is then coated with a second layer of about 0.00015" of sulfur free nickel and a second layer of about 0.00015" of sulfur containing bright nickel, after which the bright nickel is electroplated with about 0.00001" of microporous chromium.

2. A steel article coated with the composite multi-layer multi-metal coating of claim 1.

* * * * *